US008847091B2

(12) United States Patent
Zhu

(10) Patent No.: US 8,847,091 B2
(45) Date of Patent: Sep. 30, 2014

(54) SWITCH STRUCTURE FOR A POWER TOOL

(75) Inventor: Yongbing Zhu, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 350 days.

(21) Appl. No.: 13/091,779

(22) Filed: Apr. 21, 2011

(65) Prior Publication Data

US 2011/0259723 A1 Oct. 27, 2011

(30) Foreign Application Priority Data

Apr. 22, 2010 (CN) ..... 2010 2 0174025 U

(51) Int. Cl.
*H01H 3/12* (2006.01)
*H01H 9/06* (2006.01)

(52) U.S. Cl.
CPC ..... *H01H 9/063* (2013.01)
USPC ..... 200/341

(58) Field of Classification Search
CPC ..... H01H 9/063; H01H 13/14; H01H 13/705; H01H 13/52; H01H 13/023
USPC ..... 200/341, 302.3, 302.1, 339, 302.2, 552, 200/333, 332.2, 330, 61.39, 61.85, 522
See application file for complete search history.

(56) References Cited

U.S. PATENT DOCUMENTS

| | | | | | |
|---|---|---|---|---|---|
| 3,518,381 | A | * | 6/1970 | Gaynor | 200/5 E |
| 3,676,617 | A | * | 7/1972 | Miller | 200/43.08 |
| 4,169,972 | A | * | 10/1979 | Black et al. | 200/557 |
| 4,533,803 | A | * | 8/1985 | Beller et al. | 200/559 |
| 5,451,729 | A | * | 9/1995 | Onderka et al. | 200/18 |
| 5,510,583 | A | * | 4/1996 | Pescetto | 200/1 B |
| 5,725,086 | A | | 3/1998 | Cooper | |
| 5,824,982 | A | | 10/1998 | Kress | |
| 5,932,854 | A | * | 8/1999 | Umemura | 200/5 E |

* cited by examiner

*Primary Examiner* — Edwin A. Leon
(74) *Attorney, Agent, or Firm* — McDermott Will & Emery LLP

(57) ABSTRACT

The present application provides an improved switch structure for a power tool, having an outer cover, a transfer switch arranged in the outer cover, and a first button and a second button arranged on the outer cover and respectively acting on a first end and a second end of a seesaw of the transfer switch. It may also have a retaining device to keep the first button and the second button respectively jointed with the first end and the second end of the seesaw. Utilizing this arrangement of the retaining device, the button and the electric transfer switch are kept in a jointed state so that the switch does not have a loose feeling to a user which can negatively affect operation.

10 Claims, 2 Drawing Sheets

Prior Art

SWITCH STRUCTURE FOR A POWER TOOL

CROSS-REFERENCE TO RELATED APPLICATIONS

This application claims priority to CN 201020174025.0, filed Apr. 22, 2010, which is hereby incorporated by reference.

FEDERALLY SPONSORED RESEARCH OR DEVELOPMENT

Not Applicable.

TECHNICAL FIELD

The present application relates to a control switch, and more particularly to a seesaw-like switch structure used in a power tool.

BACKGROUND OF THE INVENTION

One type of switch used in a traditional power tool is a seesaw-like switch. A seesaw switch is a switch which is tightly pressured by a spring. The seesaw mounted on a pivot point, and both ends of the seesaw are connected with contact assemblies for controlling a connection terminal. When the switch is toggled, the seesaw can rotate about the pivot to create a connection point between the seesaw and the connection terminal to control an electrical connection or disconnection. In order to make the switch more intuitive or comfortable to a user during operation, each end of the seesaw-like switch may be provided with a button such that the operation thereof can be changed from a seesaw-like operation to a push-button operation. The operation principle of the push-button operation is that when one of the buttons is pressed down it causes one end of the seesaw-like switch to be pressed down, and at the same time, the other end of the seesaw-like switch is lifted up so as to lift up the other button. However, when these types of switches are used with a power tool, it is possible that the button and the seesaw like switch are not always in a complete contact and may appear loose and impact the feeling of the operation by the user.

SUMMARY OF THE INVENTION

In connection with the defects in the aforesaid prior art, the present application provides an improved switch structure for a power tool which can efficiently overcome the problem of the button being loose. By correcting the problem, the switch is more intuitive and can be more comfortably operated.

To solve the above technical problems, the present application provides an improved switch structure for a power tool. The switch structure may have an outer cover, a transfer switch arranged in the outer cover, and a first button and a second button which are arranged on the outer cover and respectively act on a first end and a second end of a seesaw of the transfer switch. The switch may also have a retaining device for retaining the first button and the second button in contact with the first end and the second end of the seesaw respectively.

As a result of the improved switch structure, due to the arrangement of the retaining device, the button and the electric transfer switch may be kept in a contact state so that the switch is not loose which will prevent associated impact to the feel of the switch during operation.

BRIEF DESCRIPTION OF THE DRAWINGS

To understand the present invention, it will now be described by way of example, with reference to the accompanying drawings in which.

DETAILED DESCRIPTION

Figure 1:
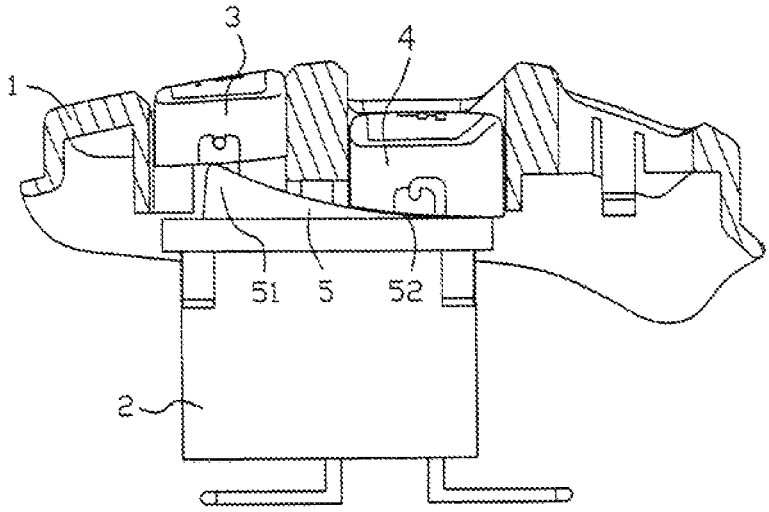
FIG. 1 is a side view of a switch for a power tool in the prior art.

FIG. 1 is a side schematic view of an existing switch for a power tool. The switch comprises an outer cover 1, a transfer switch 2 arranged in the outer cover 1, and a first button 3 and a second button 4 arranged on the outer cover 1. The first button 3 and the second button 4 respectively act on a first end 51 and a second end 52 of a seesaw 5 of the transfer switch 2.

Figure 2:
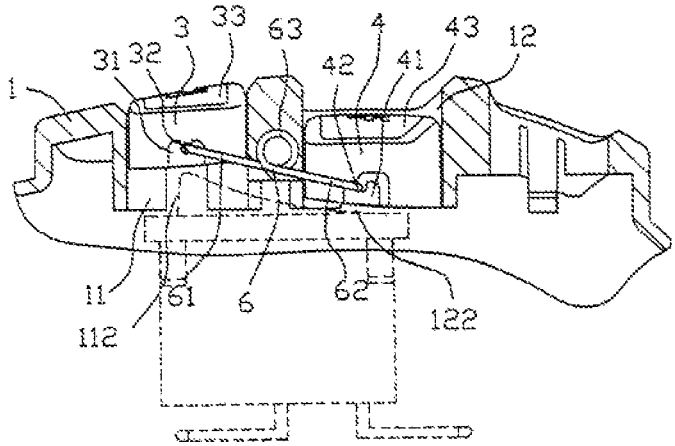
FIG. 2 is a side view of an improved switch structure for a power tool according to an embodiment of the present application.
Figure 4:
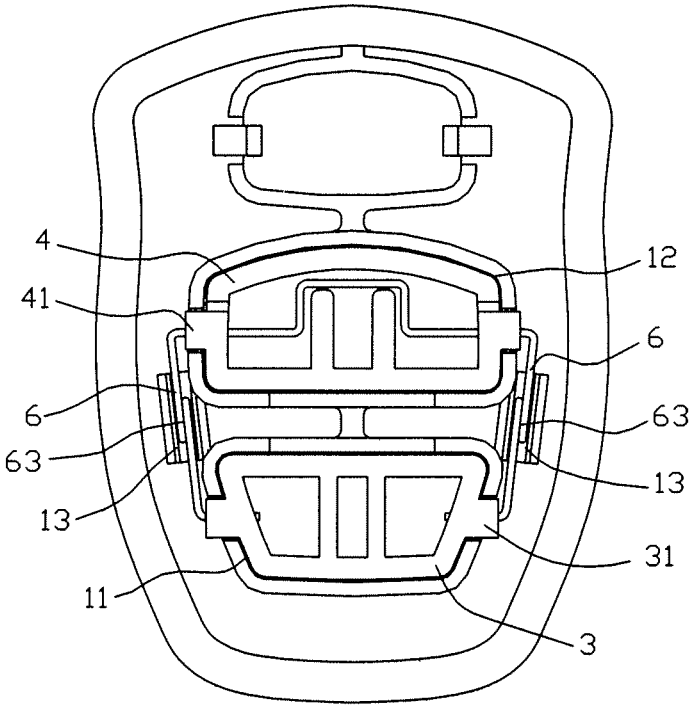
FIG. 4 is a top view of the assembled structure of the outer cover, the button and the retaining device of the switch shown in FIG. 2.

FIGS. 2 and 4 are schematic views of an improved switch structure for a power tool according to one embodiment of the present application. The improved switch structure for a power tool may have a retaining device for retaining the first button 3 and the second button 4 in contact with the first end 51 and the second end 52 of the seesaw 5 respectively. The retaining device may have an elastic element that acts on the first button 3 and the second button 4 such that the first button 3 and the second button 4 respectively bias toward the first end 51 and the second end 52 of the seesaw 5. The elastic element in the present embodiment may be a torsional spring 6, wherein two torsional arms 61, 62 on both sides of the torsional spring 6 are movably connected to the first button 3 and the second button 4 respectively and a torsional ring 63 in the middle of the torsional spring 6 rests against the inside of a slide slot 13 arranged on the outer cover 1. The outer cover 1 may have two cavities 11, 12 for sliding the first button 3 and the second button 4 between a pressed position and a rebounded position. The elongated slots 112, 122 are defined in the walls of the cavities 11, 12, and the first button 3 and the second button 4 are provided with bosses 31, 41 slidable in the elongated slots 112, 122. Additionally, the first button 3 and the second button 4 are respectively provided with holes 32, 42 through the torsional arms 61, 62 on both sides of the torsional spring 6. The torsional spring 6 is symmetrically arranged on both sides of the buttons 3, 4, and the angle between the torsional arms 61, 62 on both sides of the torsional spring 6 is preferably less than 180° with a V-shaped configuration. Accordingly, the torsional spring 6 can not only retain the buttons 3, 4 in contact with both ends 51, 52 of the seesaw 5, but also keep the buttons 3, 4 movable between the pressed position and the rebounded position in cooperation with the seesaw 5.

Figure 3:
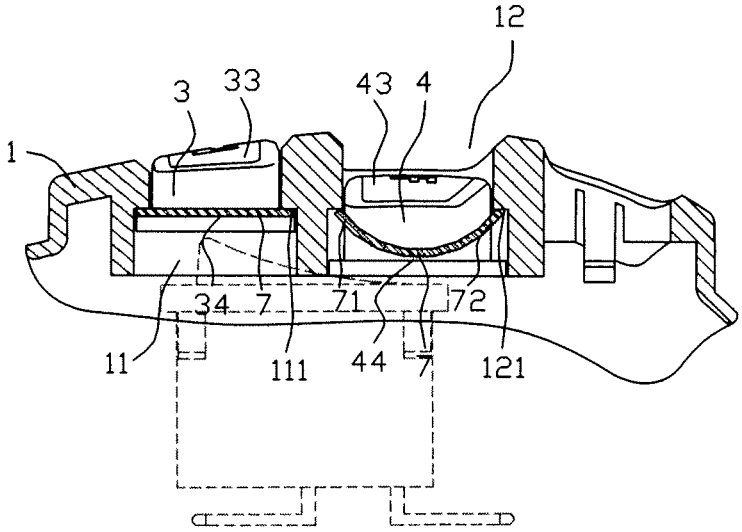
FIG. 3 is a side view of an improved switch structure for a power tool according to another embodiment of the present application.

FIG. 3 is a side schematic view of an improved switch structure according to another embodiment of the present application. The elastic element in the present embodiment is an arcuate spring leaf 7. The arcuate spring leaf 7 acts on the first button 3 and the second button 4, and both ends 71, 72 of the arcuate spring leaf 7 rest against the lower stepped surfaces 111, 121 of the outer cover 1 and the central portion of the arcuate spring leaf 7 rests against the upper stepped surfaces 34, 44 of the buttons. The buttons 3, 4 of the present application may also be provided with soft gum 33, 43.

What is claimed is:

1. An improved switch structure for a power tool comprising:

an outer cover having a first cavity and a second cavity formed therein;

a transfer switch arranged in the outer cover;

a first button arranged in the first cavity of the outer cover acting on a first end of a seesaw of the transfer switch;

a second button arranged in the second cavity of the outer cover acting on a second end of the seesaw of the transfer switch; and a retaining device for retaining the first button in contact with the first end of the seesaw and the second button in contact with the second end of the seesaw, wherein the retaining device comprises an elastic element that acts on the first button and the second button such that the first button is biased toward the first end of the seesaw at the same time the second button is biased toward the second end of the seesaw.

2. The improved switch structure for a power tool according to claim 1, wherein the elastic element is a torsional spring.

3. The improved switch structure used for a power tool according to claim 2, wherein torsional arms on both sides of the torsional spring are movably connected to the first button and the second button respectively, and a torsional ring at the central portion of the torsional spring rests against an inside of a slide slot arranged on the outer cover.

4. The improved switch structure used for a power tool according to claim 3, wherein the torsional spring is symmetrically disposed on both sides of the first button and the second button.

5. The improved switch structure used for a power tool according to claim 1, wherein the elastic element is an arcuate spring leaf.

6. The improved switch structure used for a power tool according to claim 5, wherein the arcuate spring leaf acts on the first button and the second button, and both ends of the arcuate spring leaf rest against the outer cover and central portion of the arcuate spring leaf rests against the first button and the second button.

7. The improved switch structure used for a power tool according to claim 1, wherein the buttons are provided with soft gum.

8. An improved switch structure for a power tool comprising:

an outer cover having a first cavity and a second cavity formed therein;

a transfer switch arranged in the outer cover;

a first button arranged in the first cavity of the outer cover acting on a first end of a seesaw of the transfer switch;

a second button arranged in the second cavity of the outer cover acting on a second end of the seesaw of the transfer switch;

the first and second buttons provided with soft gum material; and, a retaining device for retaining the first button in contact with the first end of the seesaw and the second button in contact with the second end of the seesaw, wherein the retaining device comprises a torsional spring, which acts on the first button and the second button such that the first button is biased toward the first end of the seesaw at the same time the second button is biased toward the second end of the seesaw.

9. The improved switch structure used for a power tool according to claim 8, wherein torsional arms on both sides of the torsional spring are movably connected to the first button and the second button respectively, and a torsional ring at the central portion of the torsional spring rests against an inside of a slide slot arranged on the outer cover.

10. The improved switch structure used for a power tool according to claim 9, wherein the torsional spring is symmetrically disposed on both sides of the first button and the second button.

* * * * *